US006848514B1

(12) United States Patent
Theurer et al.

(10) Patent No.: US 6,848,514 B1
(45) Date of Patent: Feb. 1, 2005

(54) BALLAST EXCAVATING CHAIN

(75) Inventors: Josef Theurer, Vienna (AT); Adolf Schauer, Alkoven (AT)

(73) Assignee: Franz Plasser Bahnbaumaschinen-Industriegesellschaft mbH, Vienna (AT)

( * ) Notice: Subject to any disclaimer, the term of this patent is extended or adjusted under 35 U.S.C. 154(b) by 0 days.

(21) Appl. No.: 10/890,036

(22) Filed: Jul. 13, 2004

(30) Foreign Application Priority Data

Jul. 18, 2003 (AT) ..... 514/2003 U

(51) Int. Cl.[7] ..... E01B 27/06; B65G 19/00

(52) U.S. Cl. ..... 171/16; 104/2; 198/851; 198/861.1

(58) Field of Search ..... 198/851, 852, 198/860.1, 861.1–861.6, 516, 520; 37/465; 171/2, 7.1–7.2; 104/7.1–7.3

(56) References Cited

U.S. PATENT DOCUMENTS 4,014,389 A 3/1977 Theurer et al. ..... 171/16
4,614,238 A 9/1986 Theurer et al. ..... 171/16

FOREIGN PATENT DOCUMENTS

DE 31 51 652 11/1982

*Primary Examiner*—Christopher J. Novosad
(74) *Attorney, Agent, or Firm*—Collard & Roe, P.C.

(57) ABSTRACT

An arrangement of an excavating chain for conveying ballast of a track bed comprises a guide comprising a transverse guide section articulately connected to longitudinal guide sections defining a guide channel having an end glide track along which the excavating chain is guided. The longitudinal guide sections are connected to the ends of the transverse guide section joints arranged below the second plane extending centrally through the end glide track and the excavating chain is deflected solely from the transverse to the longitudinal guide sections by frictional contact with the end glide track adjacent the joints.

2 Claims, 3 Drawing Sheets

Fig. 1
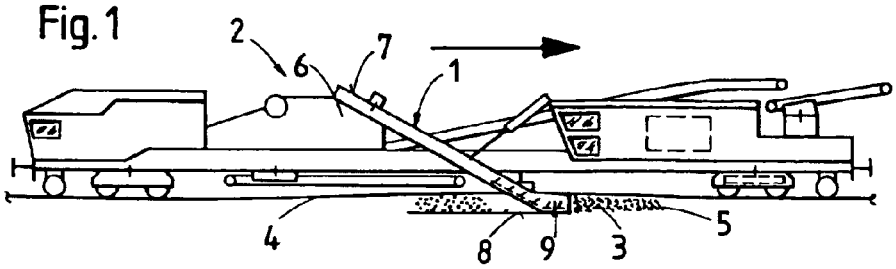
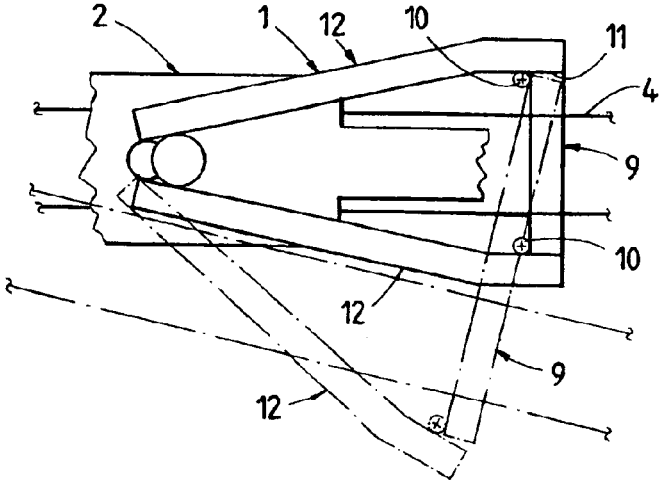
Fig. 2
Fig. 5
(PRIOR ART)
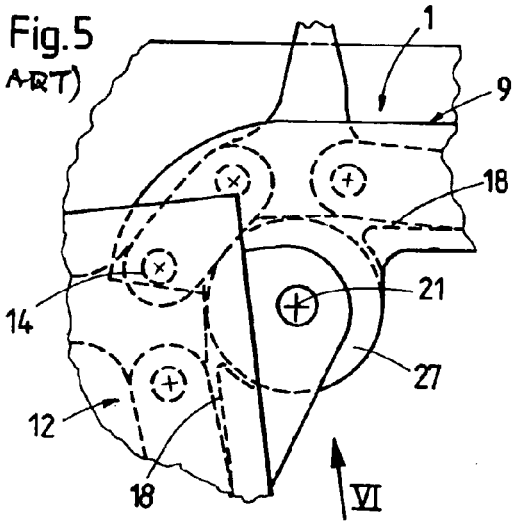
Fig. 6
(PRIOR ART)
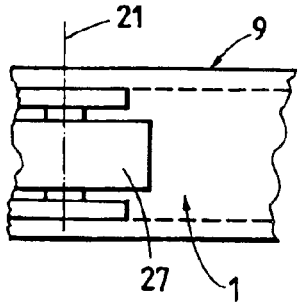

BALLAST EXCAVATING CHAIN

BACKGROUND OF THE INVENTION

1. Field of the Invention

The present invention relates to an arrangement of an excavating chain for conveying ballast of a track bed extending in a first plane, the excavating chain being comprised of a succession of linked chain links and being driven in a second plane inclined with respect to the first plane in an operating stage, and a guide wherein the excavating chain is guided, the guide comprising a transverse guide section positioned in a line of intersection of the first and second planes, in the operating stage, and longitudinal guide sections, the longitudinal guide sections being connected to ends of the transverse guide section by joints having a vertical axis and the guide sections defining a guide channel for the excavating chain, the guide channel being defined by a lower glide track and an upper glide track extending parallel to the second plane and an end glide track extending perpendicularly to the second plane, the end glide track connecting the lower and upper glide tracks.

2. Description of the Prior Art

U.S. Pat. Nos. 4,014,389 and 4,614,238 and DE 31 51 652, whose disclosures are incorporated herein by way of reference, disclose arrangements of this type, wherein an endless ballast conveyor chain is revolved around a track to excavate the ballast supporting the track and to convey the excavated ballast. The chain is guided by a transverse guide section in contact with the ballast bed during operation and longitudinal guide sections linked to the ends of the transverse guide section by joints. Guide rollers extending coaxially with the axes of the joints deflect the excavating chain from the transverse to the longitudinal guide sections. The pivotal connection between the guide sections is necessary to enable the excavating chain to be slightly displaced relative to the track. This facilitates work in restricted areas of the track. It also makes it possible to elongate the transverse guide section for operation in widened track switches. Since efficient ballast cleaning machines require the ballast excavating chain to be subjected to a tensile force of about 100 kilonewton during excavation, the amply lubricated guide rollers are subject to extremely high loads and must be frequently replaced.

SUMMARY OF THE INVENTION

It is the primary object of this invention to provide an arrangement of the indicated type whose functioning is improved without interfering with the articulate connection between the guide sections.

This and other objects are accomplished in accordance with the invention if the joints are arranged below the second plane extending centrally through the end glide track and the excavating chain is deflected solely from the transverse to the longitudinal guide sections by frictional contact with the end glide track adjacent the joints.

This enables the excavating chain to be deflected from the transverse to the longitudinal guide sections solely by frictional contact with the end glide track without the need for guide rollers. This has the great advantage that the track needs to be raised less high from the ballast bed for inserting the transverse guide section therebelow. Accordingly, the stress on the track is smaller and, due to the fact that the track does not have to be raised to the extent required heretofore, the wheel base of the ballast cleaning machine carrying the excavating chain may be reduced. Also, the very expensive conventionally used guide rollers may be dispensed with. Without guide rollers, the deflection radius may be increased so that the loads to which the excavating chain is subjected may be noticeably reduced.

BRIEF DESCRIPTION OF THE DRAWING

The above and other objects, advantages and features of the present invention will become more apparent from the following detailed description of a now preferred embodiment thereof, taken in conjunction with the accompanying drawing wherein FIG. 1 is a side elevation view of a conventional ballast cleaning machine with a ballast excavating chain;

FIG. 2 is a schematic top view of the ballast excavating chain;

FIGS. 5 and 6 are fragmentary views showing top and side views, respectively, of a conventional arrangement for deflecting the ballast excavating chain.

DETAILED DESCRIPTION OF THE PREFERRED EMBODIMENT

Figure 3:
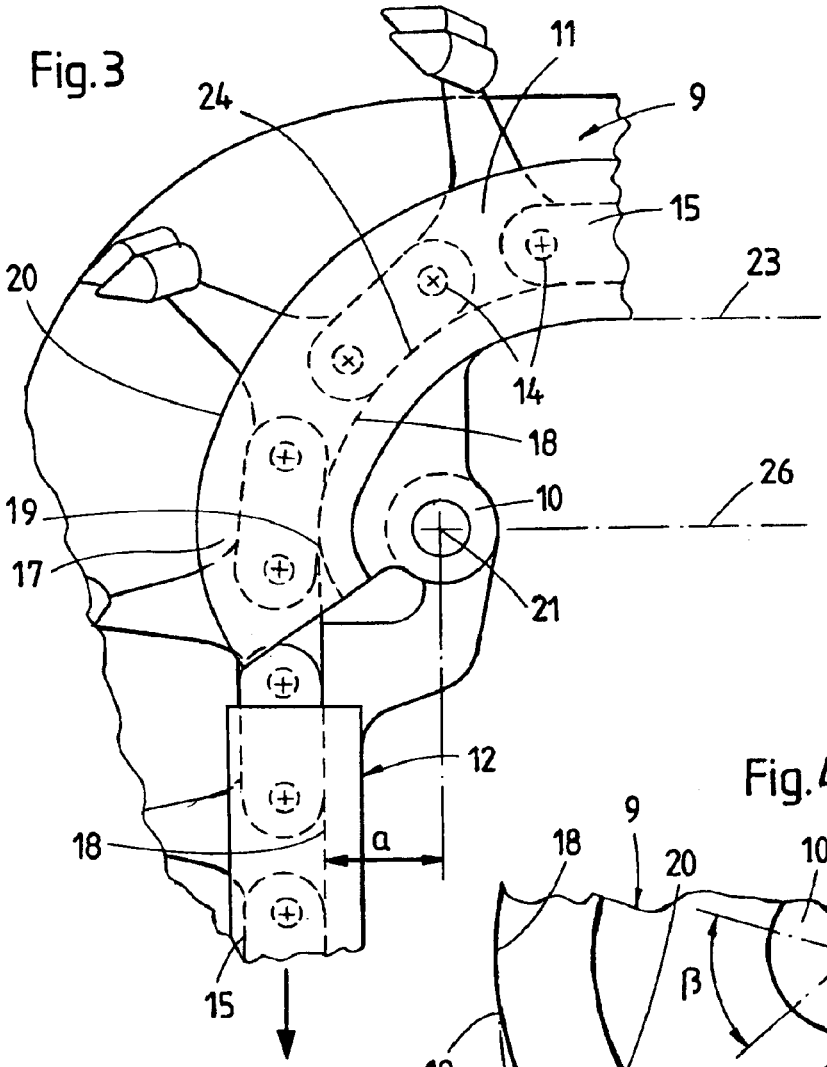
FIGS. 3 and 4 are enlarged fragmentary views showing the deflection of the ballast excavating chain between the guide sections.

Referring now to the drawing, FIG. 1 illustrates ballast cleaning machine 2 with arrangement 1 of an excavating chain for conveying ballast 5 of track bed 3 extending in first plane 8. During operation, the endless excavating chain is guided around raised track 4, excavates dirty or encrusted ballast 5, conveys it to screening apparatus 6 for cleaning, whence the cleaned ballast is returned to the track in a known manner.

As shown in FIGS. 2 and 3, the ballast excavating chain is comprised of a succession of chain links 15 linked to each other by bolts 14 and is driven in a second plane 7 inclined with respect to first plane 8 in an operating stage. The excavating chain is guided in a guide comprising a transverse guide section 9 positioned in a line of intersection of the first and second planes 7, 8, in the operating stage, and longitudinal guide sections 12. The longitudinal guide sections are connected to ends of the transverse guide section by joints 10 having vertical axis 21. The guide sections define guide channel 13 (see FIG. 5) for the excavating chain. The guide channel is defined by lower and upper glide tracks 17, 17 extending parallel to second plane 7 and end glide track 18 extending perpendicularly to the second plane, the end glide track 18 connecting the lower and upper glide tracks 17, 17. The glide tracks are of a highly wear-resistant material and are replaceably attached to guide channel 13.

As indicated in phantom lines in FIG. 2, transverse guide section 9 may be elongated for work in widened track switches, which changes the angular relationship between transverse guide section 9 and longitudinal guide sections 12.

Figure 4:
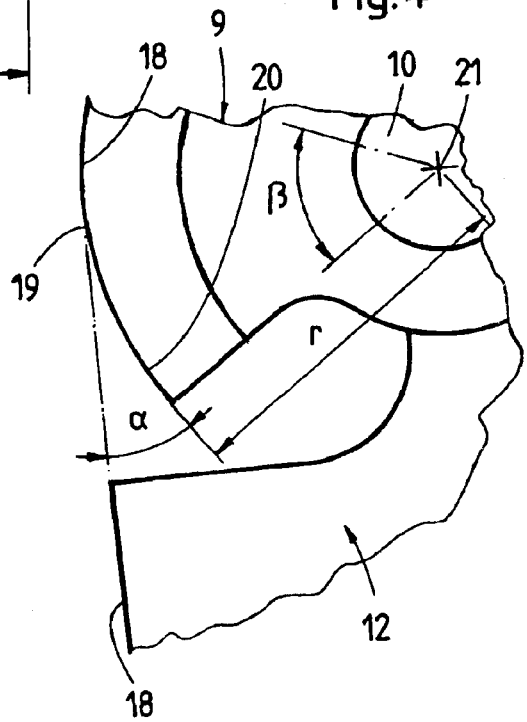

As best illustrated in FIGS. 3 and 4, the end glide track 18 of transverse guide section 9 is arcuately curved at 19 around joints 10 connecting the ends of the transverse guide section to adjoining longitudinal guide sections 12, 12. Curved end glide track 18 of the transverse guide section encloses an acute dihedral angle $\alpha$, preferably about 45°, with an imaginary plane of elongation of the end glide track of a respective one of the longitudinal guide sections (shown in phantom lines in FIG. 4) whereby the excavating chain is deflected solely from the transverse to the longitudinal guide sections by contact with end glide track 18. In other words, transverse guide section ends 20 are so curved that the excavating chain comes into contact with end glide track 18 only when the angle between transverse guide section 9 and longitudinal guide sections 12 changes. This is shown in FIG. 2 in phantom lines.

As shown in the embodiment illustrated in FIG. 3, end glide track 18 of transverse guide section 9 is arcuately curved about a center defined by vertical axis 21 of joints 10 around which the end guide track is curved.

As shown in FIGS. 3 and 4, a distance a extending perpendicularly to end glide track 18 of longitudinal guide section 12 adjoining joints 10 is identical to radius r of arcuately curved end glide track 19 of transverse guide section 9. The arcuately curved end glide track of the transverse guide section forms a circular segment with an angle β of 60°. The arcuately curved end glide track comprises a second arcuately curved end glide track 24 between linear portion 23' of transverse guide section 9 and arcuately curved end glide track 20, and the second arcuately curved end glide track is arcuately curved about a center positioned on line 26 extending parallel to linear transverse guide section portion 23 and passing through vertical axis 21 of joints 10.

This special configuration of the curved end glide track enables the ballast excavating chain to be deflected solely by frictional contact with the curved end glide track and without the need for a guide roller. In an efficient ballast cleaning machine, the excavating chain is driven, for example, with a tensile force of 110 kilonewton in the direction of the downwardly pointing arrow in FIG. 3.

This differs from the prior art arrangement 1 shown in FIGS. 5 and 6, in which the excavating chain is deflected by guide roller 27 rotatable about vertical axis 21 of the joint linking the ends of transverse guide section 9 to longitudinally guide sections 12. The guide roller projects through an opening of the end glide track 18 beyond the glide plane. This has the above-noted disadvantages and, in addition, subjects chain bolts 14 to extreme loads.

Figure 7:
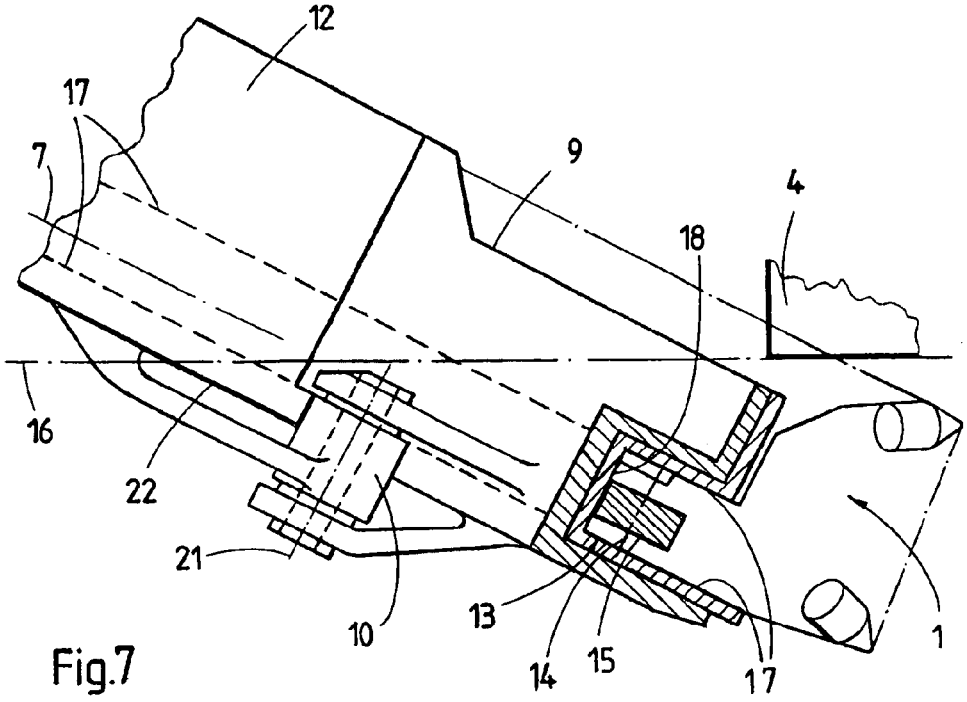
FIG. 7 is a view of the deflection area, showing the position of the joint, and the guide channel in section.

As shown in FIG. 7, joints 10 are offset in relation to lower glide track 17 of guide channel 13 so that the joints are arranged below second plane 7 extending centrally through end glide track 18, in a direction perpendicular to the second plane, and the excavating chain is deflected solely from the transverse to the longitudinal guide sections by frictional contact with the end glide track adjacent the joints. Because of the lowered positioning of joints 10, which connect the longitudinal guide sections to the ends of the transverse guide section, the track may be in such a lower raised position that an underside of a track tie, indicated by phantom line 16, extends immediately above the joints. If desired, joints 10 may be arranged fully on underside 22 of guide channel 13.

The glide tracks 17, 18 are of highly wear-resistant material and are detachably attached to the guide channel 13 in a transition from the transverse guide section 9 to the longitudinal guide sections 12.

What is claimed is:

1. An arrangement of an excavating chain for conveying ballast of a track bed extending in a first plane, the excavating chain being comprised of a succession of linked chain links and being driven in a second plane inclined with respect to the first plane in an operating stage, and a guide wherein the excavating chain is guided, the guide comprising a transverse guide section positioned in a line of intersection of the first and second planes, in the operating stage, and longitudinal guide sections, the longitudinal guide sections being connected to ends of the transverse guide section by joints having a vertical axis and the guide sections defining a guide channel for the excavating chain, the guide channel being defined by a lower glide track and an upper glide track extending parallel to the second plane and an end glide track extending perpendicularly to the second plane, the end glide track connecting the lower and upper glide tracks, wherein the joints are arranged below the second plane extending centrally through the end glide track and the excavating chain is deflected solely from the transverse to the longitudinal guide sections by frictional contact with the end glide track adjacent the joints.

2. The arrangement of claim 1, wherein the glide tracks are of highly wear-resistant material and are detachably attached to the channel in a transition from the transverse guide section to the longitudinal guide sections.

* * * * *